US008316772B1

(12) United States Patent
Gold et al.

(10) Patent No.: US 8,316,772 B1
(45) Date of Patent: Nov. 27, 2012

(54) WALL BREACHING FRAGMENTATION WARHEAD

(75) Inventors: Vladimir M. Gold, Hillside, NJ (US); Chuck L. Chin, Ledgewood, NJ (US); William J. Poulos, Park Ridge, NJ (US)

(73) Assignee: The United Stated of America as Represented by the Secretary of the Army, Washington, DC (US)

( * ) Notice: Subject to any disclaimer, the term of this patent is extended or adjusted under 35 U.S.C. 154(b) by 213 days.

(21) Appl. No.: 12/776,560

(22) Filed: May 10, 2010

(51) Int. Cl.
*F42B 12/02* (2006.01)

(52) U.S. Cl. ..... 102/519; 102/473

(58) Field of Classification Search ..... 102/468, 102/473, 489, 517, 518, 519, 520, 521, 522, 102/523
See application file for complete search history.

(56) References Cited

U.S. PATENT DOCUMENTS 3,521,564 A * 7/1970 Biehl et al. ..... 3/380
3,546,997 A * 12/1970 Biehl et al. ..... 86/1.1
4,619,203 A * 10/1986 Habbe ..... 102/516
4,776,279 A * 10/1988 Pejsa ..... 102/510
5,955,698 A * 9/1999 Harkins et al. ..... 102/399
H1938 H * 2/2001 Harkins et al. ..... 102/399
6,845,719 B1 * 1/2005 Spencer ..... 102/519

* cited by examiner

*Primary Examiner* — Troy Chambers
(74) *Attorney, Agent, or Firm* — Michael C. Sachs

(57) ABSTRACT

The invention describes a wall breaching explosive fragmentation ammunition and further a warhead having means for efficiently penetrating concrete and masonry walls, effectively delivering an explosive fragmentation case payload with minimum structural damage to the ammunition's projectile body. The effective wall breaching is achieved using an ogive-shaped, high strength, light weight boron carbide ceramic nose cone cap disposed adjacent to a tungsten alloy nose insert, at the fore of the ammunition. The projectile body is generally cylindrically shaped, preferably made of steel or aluminum to withstand expected forces in the launch environment. The ogive-shaped nose cone may be secured circumferentially to the projectile body with a rubber O-ring to ensure a tight seal. The ogive-shaped nose cone minimizes the penetration resistance force and provides more favorable loading onto the ammunition projectile's wall structure, ultimately minimizing the damage to the projectile's fragmenting case and the explosive payload which follows it. The remaining back projectile area may be filled with propellant. Use of light-weight boron carbide material also minimizes interference with possible steel fragment and tungsten alloy fragment spray. The projectile body includes rotating bands to trap propellant gases from escaping during launch which bands can be attached to the projectile body as a separate part.

16 Claims, 1 Drawing Sheet

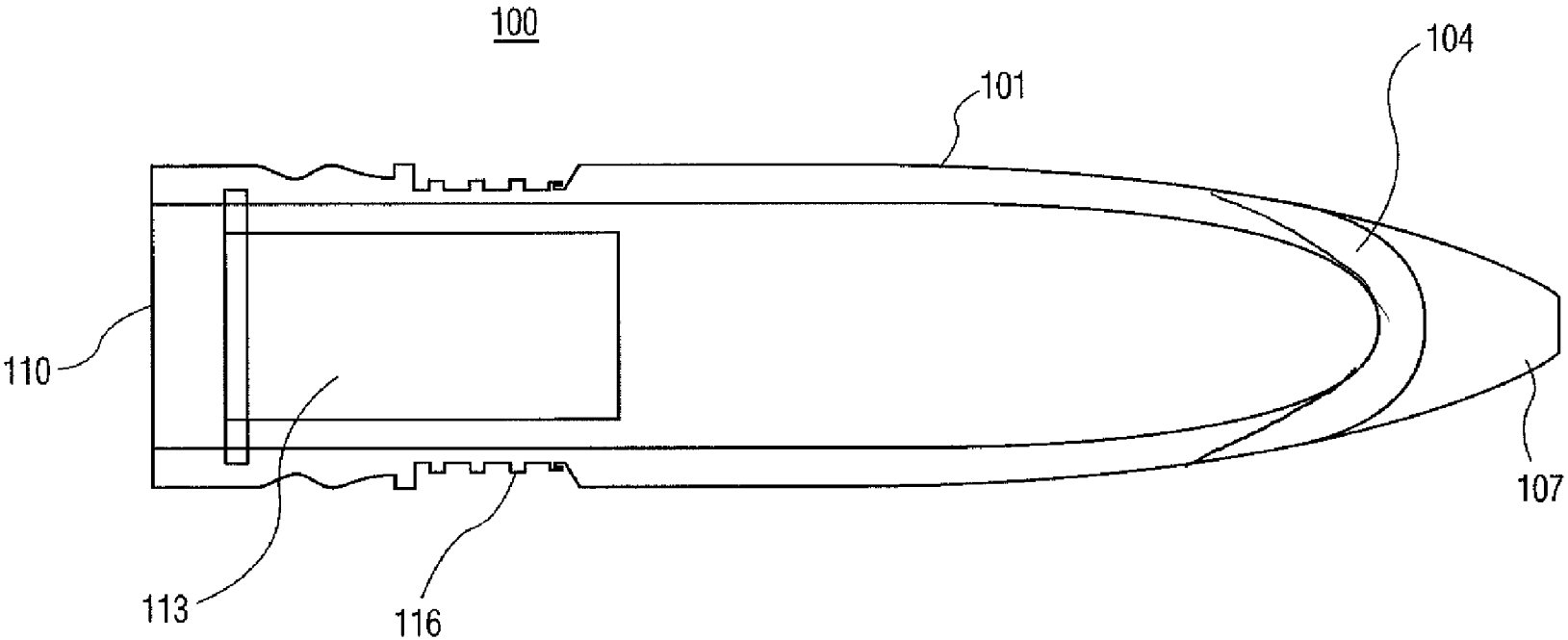
100
101
104
107
110
113
116

WALL BREACHING FRAGMENTATION WARHEAD

U.S. GOVERNMENT INTEREST

The inventions described herein may be made, used, or licensed by or for the U.S. Government for U.S. Government purposes.

BACKGROUND OF INVENTION

The invention relates to the field of ammunition for breaching a hardened target, and especially a round to breach reinforced concrete targets. Current hardened targets each require a specialized projectile. For example, presently an M830A1 round might be used for breaching steel reinforced concrete walls; an M1028 round might be used against light armor targets; an M830 round might be used for defeating bunkers; and an M908 round might be used for antipersonnel applications. Generally, in striking a target barrier wall of steel double reinforced concrete perhaps 8 inches thick, many current projectiles are not able to penetrate very deeply. Most current projectiles launched against such barriers flatten out before being able to penetrate, and then explode and the projectile warhead breaks into fragments. Although some warhead fragments will penetrate forward into the barrier as intended, yet many fragments will not and only be deflected off the barrier. Although the flattening may create a larger area of surface impact, the desired effect of clearing the target obstacle from its path isn't necessarily optimized. In most cases, the warhead actually fragments in the opposite direction of the course of the projectile, away from the target and the barrier does not receive the full effect of the explosive energy. What is needed is a projectile that is able to penetrate comparatively deep into a concrete barrier before exploding, with resulting fragments thereof all penetrating into the target. And any possible increase in fragmentation velocity upon detonation will maximize the desired effect of the projectile. A projectile is described in this invention which is capable of puncturing a double reinforced concrete wall, with projectile still essentially fully intact, and only then to have its warhead be exploded into fragments. This allows fragmentation in a more effective nearly ideal direction and nearly ideal time delay. The projectile of this invention is able to penetrate comparatively deeply into e.g., a concrete barrier before exploding, with resulting fragments of the fragmentation device thereof all penetrating into the target (as well as any other exploded fragments). This projectile is able to puncture a double reinforced concrete wall, projectile fully intact, because of the unique nose cap materials. This allows the explosives a better chance for an ideal destructive effect. Another advantage is directional in that fragmentation can this way be made to occur in a more effective direction. And a further advantage is timing. With electronic timed fuzing, the most effective timed explosive breaching capabilities can be realized.

BRIEF SUMMARY OF INVENTION

This invention relates to a wall breaching explosive fragmentation ammunition and, more particularly, to a warhead having means for efficiently penetrating concrete and masonry walls and effectively delivering an explosive fragmentation case payload with minimum structural damage to such ammunition projectile. According to an embodiment of the invention, a most effective wall breaching can be achieved by using an ogive-shaped, high strength, light weight boron carbide ceramic nose cone cap disposed adjacent to a tungsten alloy nose insert. The projectile cartridge is generally cylindrically shaped, and includes a projectile body that is preferably made of steel or aluminum or a material capable of withstanding the necessary forces of the launch environment of this ammunition. The back projectile area generally may be filled with propellant such as JA-2. The projectile body is closed at its front or distal end with the ogive-shaped nose cone. The ogive-shaped nose cone includes a hollow cylindrical end that engages the distal end of the projectile body and may be secured circumferentially thereto e.g. by means of an O-ring (not shown). The O-ring would be preferably made of rubber to ensure a tight seal between the ogive-shaped nose cone and the projectile body. The ogive-shaped nose cone minimizes penetration resistance force and provides more favorable loading onto the projectile body wall structure, ultimately minimizing damage to the projectile body's fragmenting case and the explosive payload which follows it. The explosive payload might be filled with PAX-3 high explosive, e.g. use of light-weight boron carbide material also minimizes possible interference with steel fragment and tungsten alloy fragment spray. The projectile body includes rotating bands to trap propellant gases from escaping during launch. These bands (also called bourrelets) are a ring of material that is softer than the projectile body material, to act as seal against propellant gases escaping into the space between projectile body and barrel. The rotating bands are preferably made of copper and can be attached to the projectile as a separate part. The projectile body could also include a further mission canister that is housed within the projectile body as may be desired. In a preferred embodiment, such canister might house a fuze timing device and a power source that is activated upon launch of the projectile, e.g. the projectile body construction might include use of a joined cartridge case. With such cartridge case engaged to the projectile body, the cartridge case would form a low pressure chamber with the projectile body. The projectile could approach a high low pressure concept that starts with a high pressure build up in a small chamber then which bleeds pressure into a low pressure area at a controlled rate in order to push the projectile body all the way out the barrel of the gun providing consistent pressure the whole way. The proximate end of the projectile body could include an aperture for retaining a base plug which in turn could house an ejection charge that is disposed in proximity to an ignition delay element. Such ejection charge could be used to push a further mission payload out of the projectile after an appropriate time delay. The base plug could secure a primer, a propellant cup, and a propellant charge, such as an M9 propellant charge, within the cartridge case. At least one vent could connect the propellant cup to the low pressure chamber. While the invention is described here in terms of breaching reinforced concrete walls, this ammunition is also capable of breaching light armor targets, bunkers, could be used in munitions for urban terrain warfare, and might also be used for antipersonnel purposes.

OBJECTS OF THE INVENTION

It is therefore an object of the present invention to provide an ammunition round that may be used to defeat hardened targets, and;

It is a further object of the present invention to provide ammunition which may be used to breach concrete and masonry walls, and;

It is a still further objective of the present invention to provide ammunition which may be used to breach at least eight inch thick hardened steel double reinforced concrete wall targets in a frontal strike.

These and other objects, features and advantages of the invention will become more apparent in view of the within detailed descriptions of the invention and in light of the following drawing(s). It should be understood that the sizes and shapes of the different components in the FIGURE(S) may not be in exact proportion and are shown here for visual clarity and for purposes of explanation.

DESCRIPTION OF DRAWING(S)

FIG. 1 shows a cross section of a concrete wall breaching ammunition according to the invention.

DETAILED DESCRIPTION

FIG. 1 shows a wall breaching explosive fragmentation ammunition 100 with warhead having means for efficiently penetrating concrete and masonry walls, effectively delivering an explosive fragmentation case payload 101 with minimum structural damage to such ammunition projectile body. An ogive-shaped, high strength, light weight boron carbide ceramic nose cone cap 107 is disposed at the fore of the projectile, followed by a tungsten alloy nose insert 104. The boron carbide ceramic nose cone cap 107 is approximately 30 mm in diameter, about 25 mm in depth, and the tungsten alloy nose insert 104 is about 3 mm thick. Projectile 100 is generally cylindrically shaped, and includes a projectile body 110 that is preferably made of steel or aluminum or any material capable of withstanding the necessary forces of the launch environment of this type projectile. The back projectile area may be filled with, e.g., JA-2 propellant. The projectile body 110 is closed at its front or distal end with an ogive-shaped nose cone. The ogive-shaped nose cone includes a hollow cylindrical end that engages the distal end of the projectile body 101 and may be secured circumferentially thereto e.g. by means of an O-ring (not shown). The O-ring would be preferably made of rubber to ensure a tight seal between the ogive-shaped nose cone and the projectile body 101. The ogive-shaped nose cone minimizes the penetration resistance force and provides more favorable loading onto the ammunition projectile's wall structure, ultimately minimizing the damage to the projectile's fragmenting case 101 and the explosive payload 113 which might be filled with PAX-3 high explosive. Using light-weight boron carbide material minimizes interference with the steel fragment spray from 101, and with the tungsten alloy fragment spray from 104. The projectile body 101 includes a rotating band 116 to trap propellant gases from escaping during launch. The rotating band 116 (also called a bourrelet) is here preferably made of copper and attached to the projectile as a separate part. The projectile could have several bourrelets such as a midway bourrelet around the outside surface, and also bourrelet(s) at the aft portion of the projectile. If so, the bourrelet locations may be specifically selected so that the center of gravity of the entire projectile (including all parts from nose to aft) is directly in between the midway and the aft bourrelets; this done to create more bore stability. This means that there is less movement in the barrel of the gun which, in return, allows a more consistent launch. The projectile 100 could also include a canister that is housed within the projectile body 110. In one embodiment, the canister might house a fuze timing device and a power source that is activated upon launch of the projectile. The projectile 100 might include a joined cartridge case. The case could have a substantially cylindrical outer shape. When such cartridge case is engaged to the projectile body 110, the cartridge case would form a low pressure chamber with the projectile body 110. The projectile could approach a high low pressure concept that starts with a high pressure build up in a small chamber and bleeds pressure into a low pressure area at a controlled rate in order to push the projectile all the way out the barrel of the gun providing consistent pressure the whole way. The proximate end of the projectile body 110 could include an aperture for retaining a base plug which in turn could house an ejection charge that is disposed in proximity to an ignition delay element. Such ejection charge could be used to push a payload out of the projectile after an appropriate time delay. The base plug could secure a primer, a propellant cup, and a propellant charge, such as an M9 propellant charge, within the cartridge case. At least one vent could connect the propellant cup to the low pressure chamber. In yet other variations, the cartridge might also have a base data link, a point detonate switch, a base detonating fuze (multi mode programmable), a warhead closure disc, and a projectile body having folding fins. The aft areas might also have a boom, e.g., in some configurations.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An ammunition used to assault a hardened target, comprising:

a generally cylindrically shaped steel or aluminum projectile body;

a tungsten alloy nose insert, secured circumferentially to the fore of the projectile body;

an ogive-shaped, high strength, light weight boron carbide ceramic nose cone cap secured on the aft side of said tungsten alloy nose insert; and wherein an explosive payload is carried within the interior of the projectile body; and wherein the remaining interior area of said projectile body is substantially filled with propellant.

2. The ammunition of claim 1 wherein the projectile body is made from steel.

3. The ammunition of claim 1 wherein the projectile body is made from aluminum.

4. The ammunition of claim 1 wherein the tungsten alloy nose insert is secured by means of an O-ring.

5. The ammunition of claim 4 wherein the O-ring is made of rubber.

6. The ammunition of claim 1 wherein the explosive payload is PAX-3.

7. The ammunition of claim 1 wherein the propellant is JA-2.

8. The ammunition of claim 1 wherein the ammunition has rotating bands attached to the projectile body to trap propellant gases from escaping during launch.

9. The ammunition of claim 8 wherein the rotating bands are made of copper.

10. The ammunition of claim 1 wherein the hardened target comprises double steel reinforced concrete.

11. The ammunition of claim 10 wherein the double steel reinforced concrete is an at least eight inches thick wall.

12. The ammunition of claim 1 wherein the hardened target comprises a bunker.

13. The ammunition of claim 1 wherein the hardened target comprises a masonry wall.

14. The ammunition of claim 1 wherein the hardened target comprises light armor.

15. The ammunition of claim 1 used in munitions for urban terrain warfare.

16. The ammunition of claim 1 used in munitions for anti-personnel purposes.

* * * * *